US005226527A

United States Patent [19]

Maurer et al.

[11] Patent Number: 5,226,527

[45] Date of Patent: Jul. 13, 1993

[54] VACUUM CLEANER REMOTE SWITCH ACTUATOR

[75] Inventors: Edgar A. Maurer; Herbert Morello, both of Canton; Douglass A. King, North Canton, all of Ohio

[73] Assignee: The Hoover Company, North Canton, Ohio

[21] Appl. No.: 881,199

[22] Filed: May 11, 1992

[51] Int. Cl.[5] ..... H01H 3/54

[52] U.S. Cl. ..... 200/331; 200/332.2

[58] Field of Search ..... 200/332.2, 337, 338, 200/332.1, 331; 15/DIG. 10

[56] References Cited

U.S. PATENT DOCUMENTS

| | | | |
|---|---|---|---|
| 481,826 | 8/1992 | Sanford . | |
| 2,218,161 | 10/1940 | Bery | 15/DIG. 10 |
| 2,243,067 | 5/1941 | Berg | 306/11 |
| 2,314,334 | 3/1943 | Frantz | 15/16 |
| 2,842,788 | 7/1958 | Rench et al. | 15/48 |
| 3,242,298 | 3/1966 | Miller | 200/338 |
| 4,051,340 | 9/1977 | Wolski | 200/337 X |
| 4,280,026 | 7/1981 | Alessio | 200/331 X |
| 4,380,693 | 4/1983 | Kuhlmann et al. | 200/337 X |
| 4,421,964 | 12/1983 | Buchtel | 200/332.2 |
| 4,421,964 | 12/1983 | Buchtel | 200/332.2 |
| 4,870,232 | 9/1989 | Hoogland | 200/331 |

FOREIGN PATENT DOCUMENTS

| | | | |
|---|---|---|---|
| 133852 | 6/1933 | Austria | 15/DIG. 10 |
| 563025 | 9/1958 | Canada . | |

OTHER PUBLICATIONS

Photos Elite TM Cleaner—Hoover—Early Production Mar. 1988.

*Primary Examiner*—Renee S. Luebke

[57] ABSTRACT

A switch actuator for an upright vacuum cleaner consists of two elongated rod sections adapted for interconnection by means of a barbed clevis at the end of one of the sections adapted for engaging a receptacle at the end of the other section. One of the sections is maintained within an upper handle portion and the other within a lower handle portion of the vacuum cleaner. As the two handle portions are interconnected, interconnection of the actuator rod sections is automatically effectuated. The actuator rod section maintained in the upper handle portion is also adapted to receive an actuator button which has a connector passing through a slot in the vacuum cleaner handle. The button remains external to the vacuum cleaner handle, while the connector portion thereof extends internally thereof and mates with one of the actuator rod sections.

7 Claims, 3 Drawing Sheets

VACUUM CLEANER REMOTE SWITCH ACTUATOR

TECHNICAL FIELD

The invention herein resides in the art of vacuum cleaning devices of the floor care type. Particularly, the invention relates to a power switch actuator for upright cleaners. More specifically, the invention relates to such a switch actuator having an elongated linkage allowing the operator to maneuver a button at a handle of the sweeper to actuate a switch in a remote power head.

BACKGROUND ART

Presently, the bulk of consumer products are sold by mass merchandizing. Large retail stores are provided with elaborate arrays of shelves, counters, and floor displays for maintaining boxed products offered for sale. Such retail establishments have minimized the number of store personnel required to operate the same, thus increasing the overall profitability of the store. Additionally, in order that a large variety of products may be made available for sale, the amount of shelf space allotted to each product is carefully determined. With such shelf space restrictions, the manufacturers of products are under increasing pressure to present the same in compact packages having point of sale advertising and promotional material imprinted thereon. Such compact packaging gives rise to the need for assembly of most products by the consumer subsequent to their purchase.

It is most desirable that consumer products requiring assembly by the purchaser be so designed and configured to minimize the complexity of the assembly procedure and to further minimize the requirement of tools and mechanical aptitude. Such products oftentimes are provided with mating snaps or latches allowing modularized portions of the product to be "snap fit" together with the ultimate securement being attained by means of a minimum of screws or the like. Electrical interconnections between the various product portions are generally facilitated by means of plugs and jacks or other similar electromechanical devices. Typically, when modularizing products for packaging purposes, it is most desirable that the extension of elements from one module to the other be minimized such that only housings need be interconnected, rather than mechanically or electrically operative parts.

It has previously been known that floor care cleaning devices such as upright cleaners may be marketed in a compact package by presenting the cleaner as three separate structural elements adapted to be quickly and easily interconnected with each other, employing a minimum number of tools and mechanical dexterity. Such upright cleaners are typically packaged with a separate cleaner head or body, a lower handle portion, and an upper handle portion. Those skilled in the art will recognize that in such upright cleaners, the cleaner head or body receives and houses the vacuum and agitator motor, agitator, brush assembly, and power switch. The lower handle portion is typically provided with a dirt receptacle or means for supporting a filter bag or the like, along with the requisite air passage conduit to allow the dirt receptacle or bag to intercommunicate with the vacuum-generating motor. The upper handle portion is typically provided with a hand grip at a remote end thereof, a bag strap for securing a top end of the filter bag, and cord hooks or the like for receiving and maintaining the power cord. As will be appreciated below, the prior art upright cleaners have typically been configured such that the three structural elements may be quickly and easily interconnected by snap-fit connectors, with ultimate securing engagement being provided by a screw at the point of interconnection.

To minimize the number of mechanical and/or electrical interconnections between the three portions of the upright cleaners discussed above, the actuator button for the power switch of the cleaner has typically been positioned on the lower handle portion. However, such positioning has been found to be inconvenient, principally due to its remote location from the hand of the operator. It is most desirable that the power switch and associated actuator button be positioned near the hand grip on upper handle portion to be readily accessed by the user during normal operation. However, to position the actuator button and power switch at the handle grip necessarily requires that electrical wires communicate with each of the three modularized portions of the cleaner from the switch to the motor. The interconnection of the switch and motor so positioned is simply not given to ease of the assembly by a customer, since passing of electrical wires through the three separate components greatly complicates the assembly procedure. Additionally, the cost of the cleaner would be greatly aggravated by the inclusion of interconnecting plugs at the interfaces of various modules if that approach were taken.

It has also been known in the art that the switch and actuator of a floor care cleaning device may be remotely interconnected by a wire or cable. The use of a Bowden cable or a wire form for such purposes is well known. The former consists of a fixed shield slidingly receiving a central wire or cable connected at one end to the switch and at the other to the actuator. The latter consists of a substantially rigid wire received in guides and similarly interconnected. Neither the Bowden cable nor the wire form are given to division into segments received in respective modules or product portions and which may be easily and effectively joined. Indeed, the complexity and cost of such remote actuators are aggravated by attempts at modularization of the same.

Accordingly, there is a need in the art for an extended mechanical linkage from the hand grip of the upper handle portion of the vacuum cleaner to the power switch in the cleaner head, which mechanical linkage is sectioned such that one portion thereof is retained in the upper handle assembly and the second portion thereof is retained in the lower handle assembly, which portions are easily attached and detached during assembly and disassembly operations. Additionally, there is a need in the art for a simple actuator button which may be interconnected with such linkage and which may be quickly and easily attached and detached with respect thereto and which may be maintained at the hand grip of the upper handle portion.

DISCLOSURE OF INVENTION

In light of the foregoing, it is a first aspect of the invention to provide a switch actuator for a vacuum cleaner which extends from the hand grip to the cleaner head.

Another aspect of the invention is the provision of a switch actuator for a vacuum cleaner which is segmented, portions of the actuator being uniquely retained in each of the upper and lower handle portions.

Still a further aspect of the invention is the provision of a switch actuator for a vacuum cleaner which is segmented into easily attachable and detachable segments.

Yet an additional aspect of the invention is the provision of a switch actuator for a vacuum cleaner having an actuator button received at the hand grip of the cleaner and which is easily attachable and detachable to a mechanical linkage extending to a power switch in the cleaner head.

An additional aspect of the invention is the provision of a switch actuator for a housing which is reliable and durable in use and easily constructed from state of the art materials and employing state of the art techniques.

The foregoing and other aspects of the invention which will become apparent as the detailed description proceeds are achieved by a remote switch actuating mechanism for use with a cleaner, comprising: a manual switch member mounted with said cleaner; a multi-part operating rod attached to said member for actuation thereby; a remote switch mounted with said cleaner for actuation by said member; a clevis portion on one of said parts of said operating rod telescopically received over another part of said rod; and fastening means operatively maintaining said telescopic reception.

Other aspects of the invention are achieved by a remote switch actuating mechanism for use with a cleaner, comprising: a switch; an operating rod for switch actuation; a switch button driving said operating rod, said switch button including an operator contactable portion and a portion for attachment to said operating rod, said attachment portion extending through said rod and a cleaner housing portion to attach to said rod; and wherein said switch button is disposed outside of said cleaner housing portion whereby movement of said switch button drives said rod for switch actuation.

DESCRIPTION OF DRAWINGS

For a complete understanding of the objects, techniques, and structure of the invention reference should be made to the following detailed description and accompanying drawings wherein:

FIGS. 1A, 1B, and 1C are elevational views, in partial section, of portions of an upright vacuum cleaner employing the invention, and wherein FIG. 1A is such a view of the upper handle portion; FIG. 1B is such a view of the lower handle portion, and FIG. 1C is such a view of the cleaner body;

BEST MODE FOR CARRYING OUT THE INVENTION

Figure 1A:
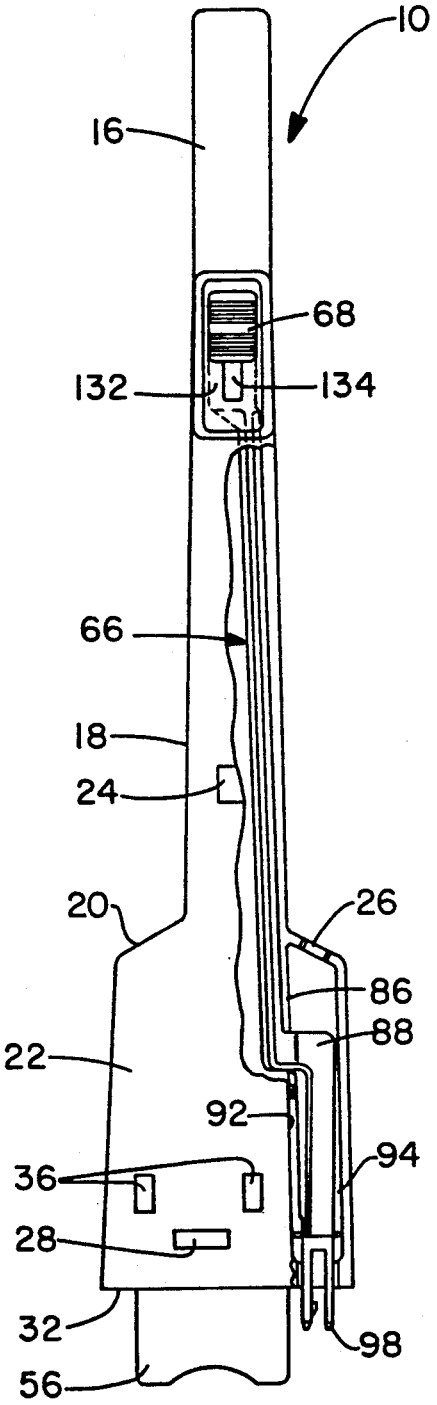
Figure 1B:
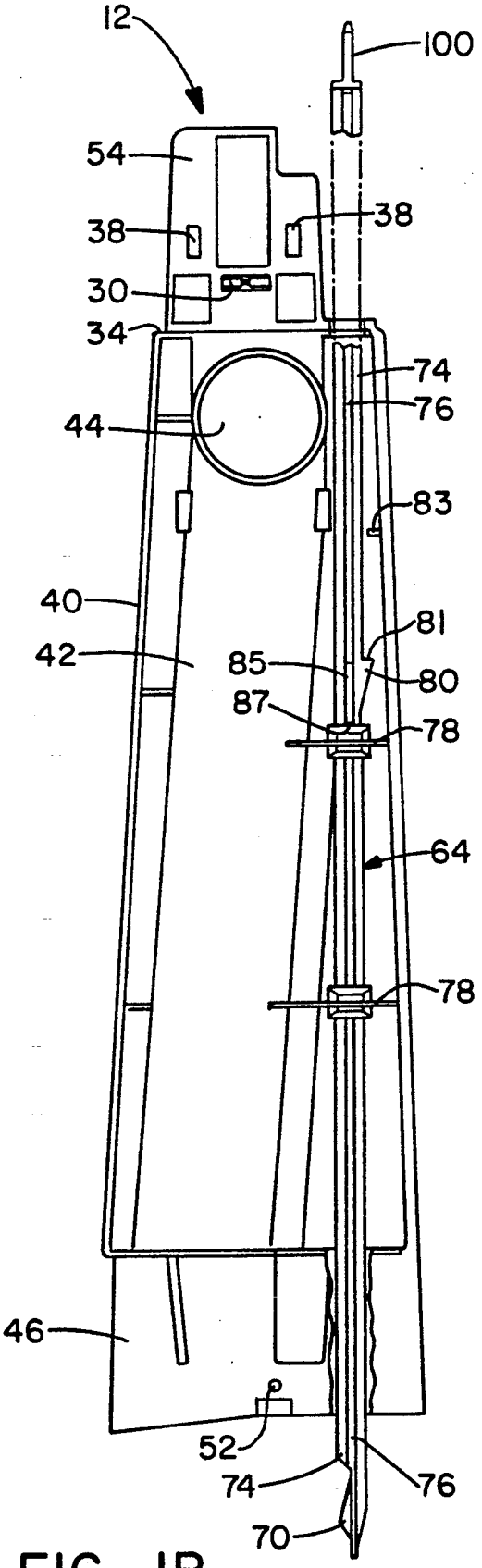
Figure 1C:
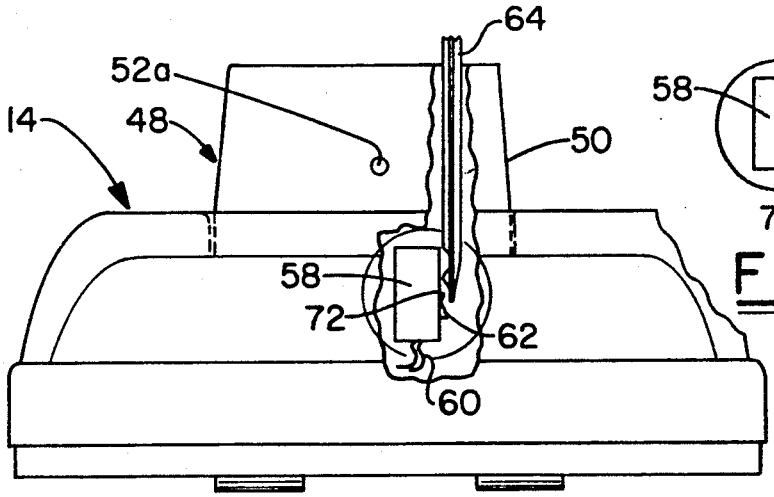
Figure 1D:
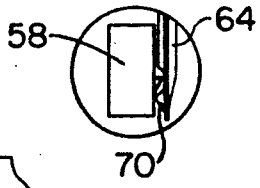
FIG. 1D is an enlarged fragmentary view of the circled structure in FIG. 1C.

Referring now to the drawings and more particularly FIGS. 1A–1C, the assembly of a floor care cleaning device such as an upright vacuum cleaner embodying the concept of the invention can be seen. As shown, an upper handle portion 10 is adapted to interconnect with the lower handle portion 12 which, in turn, is received by the motor fan housing 48 contained in the cleaner body 14. Those skilled in the art will readily appreciate that the elements 10, 12, 14 will typically be of molded plastic construction, defining housings for receiving and maintaining operative structure of the vacuum cleaner as will become apparent below. Those skilled in the art will further understand that the structural portions 10, 12, 14 are received and maintained in a single package maintaining the entirety of the vacuum cleaner at a point of sale display or the like. Such elements are adapted to be snap fit or otherwise be quickly, easily, and securedly interconnected with each other.

A hand grip 16 extends from an end of the upper handle portion 10 and is angled with respect to the central axis thereof. Such handle grip 16 may be provided with finger receiving depressions, grip texture, or the like to accommodate the hand of an operator. Extending from the hand grip 16 is a stem 18 which flares outwardly at the shoulders 20 to a body portion 22. An aperture 24 is provided in the stem 18 and is adapted to receive a strap or other cleaner bag retaining means as is well known and understood in the art. In one embodiment of the invention, a spring biased strap extends from the aperture 24 and is adapted to make securing and retaining engagement with a cloth dust bag adapted to receive and maintain a filter paper bag therein.

As is also known in the art, a second aperture 26 is provided in one of the shoulders 20 of the upper handle portion 10, the same being adapted to receive an electrical power cord. A cord protector device would typically be received within the aperture 26 in standard fashion.

As mentioned above, the elements of the vacuum cleaner of the invention are adapted to be snap fit together. To that end, a receptacle 28 is provided in the body portion 22 and is adapted to engage a tab or protrusion 30 extending outwardly from a mating portion of the lower handle assembly 12. Those skilled in the art will understand that the body portion 22 is deflected over the tab or protrusion 30 during the mating engagement of the handle portions 10, 12 until the receptacle 28 is in registration with the protrusion 30 and the bottom lip 32 of the upper handle portion 10 is in engagement with the top lip 34 of the lower handle portion 12. At this time, the body 22 returns to its undeflected state with the protrusion 30 extending outwardly from the receptacle 28 to maintain the handle portions 10, 12 in fixed registration with each other. Final secured engagement is achieved by means of the openings 36 passing through the body 22 and in alignment with the openings 38 within the lower housing portion 12. A bag support flange or the like is secured through the holes 36 and into the holes 38 for finalizing and fixing the secured engagement between the handle portions 10, 12 while securing the filter bag in place, all well known to those skilled in the art.

As shown in FIG. 1B, the lower handle portion 12 includes a conduit 42 to pass the dirt laden air of the vacuum cleaner from the vacuum cleaner nozzle of the housing 14 to an orifice 44. An appropriate filter bag is interconnected with the orifice 44 in standard fashion, with the outer cloth bag thereof being secured by means of a strap extending from the aperture 24 as discussed above. It will, of course, be appreciated by those skilled in the art that the lower handle portion 12 mates with the cleaner body 14 such that the conduit 42 communicates with the vacuum generated in the envelope by the motor housed therein. To that end, a sleeve coupler 46 extends from the bottom of the lower handle portion 12 and is adapted to telescopically receive the neck 50 of the motor fan housing 48 as shown in FIG. 1C. A hole 52 passing through the coupler 46 aligns with the hole 52*a* of the neck 50, which holes are adapted to receive a screw or the like to effect final securement of the lower handle portion 12 to the cleaner body 14 in a manner well known and understood in the art.

With further attention to FIGS. 1A and 1B, it can be seen that interconnection of the upper and lower handle portions 10, 12 is achieved in a manner similar to that of the interconnection of the lower handle portion 12 with the cleaner body 14. As illustrated, a coupler 54 extends upwardly from a top end of the lower handle portion 12, while a spade 56 extends downwardly from a bottom end of the top handle portion 10. The coupler 54 is received within the body 22 while the spade 56 slides behind the coupler 54 to provide for stability and rigidity at the junction so defined.

As shown in FIG. 1C, the motor fan housing 48 maintains a power switch 58 therein. Power lines 60 adapted to interconnect with a wall socket and a motor (not shown) are also maintained in the motor fan housing 48. The switch 58 is interposed in one of the power lines 60 to connect and disconnect the power source from the motor dependent upon the state of actuation of the rocker actuator 62 of the switch 58.

It will now be appreciated by those skilled in the art that the structure described thus far with respect to FIGS. 1A–1C constitute the general state of the art of vacuum cleaners or floor care devices which are modularized or otherwise separated into distinct functional subassemblies. This art is improved by the invention herein through the provision of a linkage interconnecting the rocker actuator 62 of the switch 58 with an actuator button at the hand grip 16 of the upper handle portion 10. As shown in FIGS. 1A and 1B, a lower actuator rod 64 is received within the lower handle portion 12 and is interconnected with an upper actuator rod 66 within the upper handle portion 10. Interconnected to the end of the upper actuator rod 66 is an actuator button 68, slidingly maintained at the hand grip 16.

Figure 2:
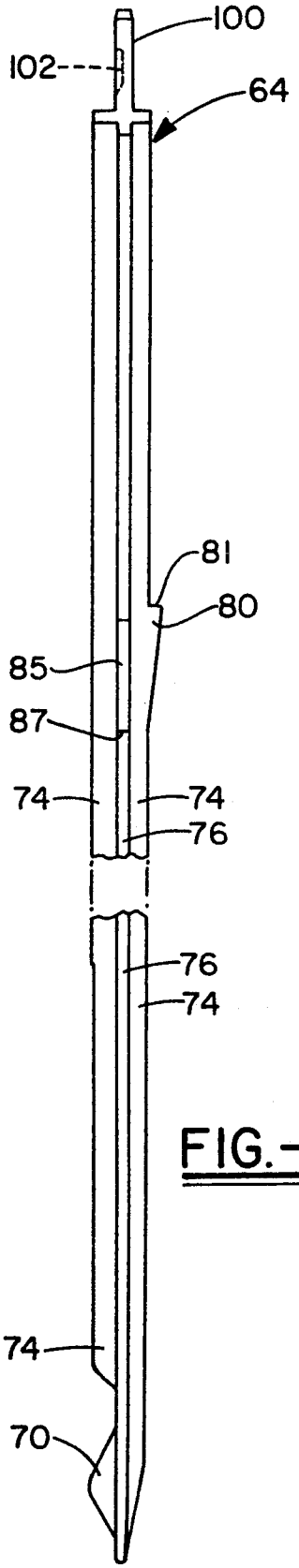
FIG. 2 is a front elevational view of the lower actuator rod of the invention.

As shown in FIG. 2, a cam 70 is formed at the end of the lower actuator rod 64 and is configured to be matingly received within the notch 72 of the rocker actuator 62. Accordingly, reciprocating movement of the lower actuator rod 64 actuates and deactuates the switch 58 by the cammed engagement at 70, 72.

Figure 8:
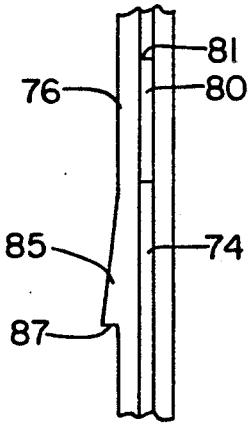
FIG. 8 is a partial side elevational view of the lower actuator rod of the invention showing a stop fin thereof.

The lower actuator rod 64 may be of any of numerous configurations. In the preferred embodiment, it is formed by a pair of intersecting elongated planar pieces 74, 76, the same orthogonally intersecting such that the cross sectional configuration of the rod 64 is cross-shaped. The rod 64 is received within guides or ways 78 of rectangular cross section, dimensioned to slidingly receive the rod 64. As shown, the ways 78 are interconnected between the housing 40 and conduit 42, although they may be fixedly maintained in any appropriate fashion. Extending from the elongated planar piece 74 is a fin 80 having a lip 81 positioned to engage a stop 83 extending inwardly from an outer wall of the housing 40, serving as a stop to limit the movement of the rod 64 in an upward direction as shown in FIG. 1B prior to interconnection of the upper handle portion 10 and lower handle portion 12. As shown in FIGS. 1B and 8, the lower actuator rod 64 is provided with a second fin 85 inclined in a direction opposite that of the fin 80, and having a lip 87 positioned to engage an outer surface of one of the guides 78 which serves as a stop to limit downward movement of the rod 64 as shown in FIG. 1B.

Figure 3:
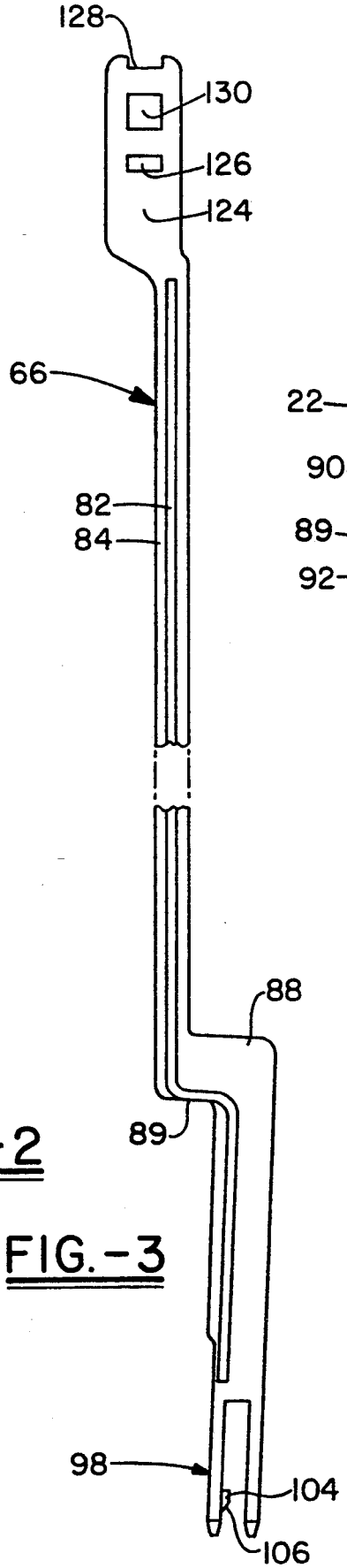
FIG. 3 is a front elevational view of the upper actuator rod of the invention.

As shown in FIG. 3, the upper actuator rod 66 comprises an elongated planar piece 82 having a top rib 84 orthogonally extending therefrom. In the preferred embodiment of the invention, a corresponding rib extends from the opposite side of the piece 82 along at least a portion thereof. Such ribs provide a degree of rigidity to the rod 66.

Figure 7:
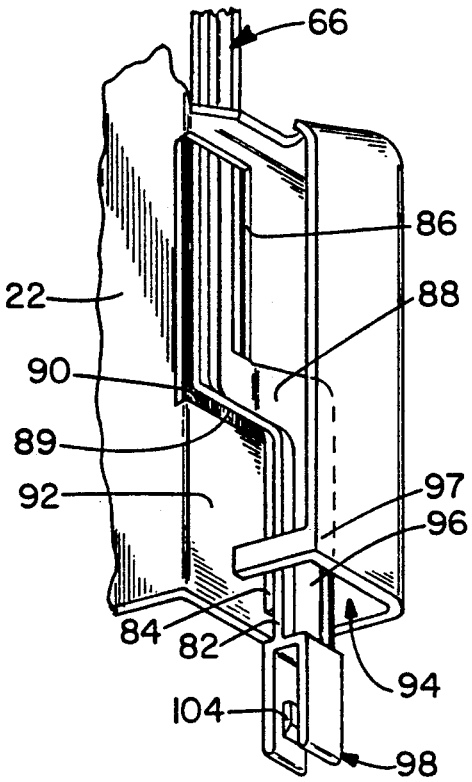
FIG. 7 is a partial perspective view of the upper actuator rod showing an elbow of the same slidingly received by a support structure.

As shown in FIGS. 1A and 7, a passage 94 is defined between a wall 92 and the housing of the upper handle portion 10. The passage 94 receives the leg 96 of the rod 66 which is offset by the elbow 88. A window 90 within the wall 92 provides a passage for the transition of the elbow 88 and further provides a bearing surface 86 for sliding receipt and support of a bottom surface 89 of the elbow 88. The leg 96 is also slidingly received in a guide 97, as shown.

It will be appreciated that the overall longitudinal configuration of the upper actuator rod 66 substantially tracks the outer periphery of the stem 18 and body 22 of the handle portion 10. In like manner, the lower actuator rod 64 closely tracks a side edge portion of the housing 40. Accordingly, the totality of the actuator rod 64, 66 is minimally obstructive to elements maintained within the handle portion 10, 12.

Figure 4:
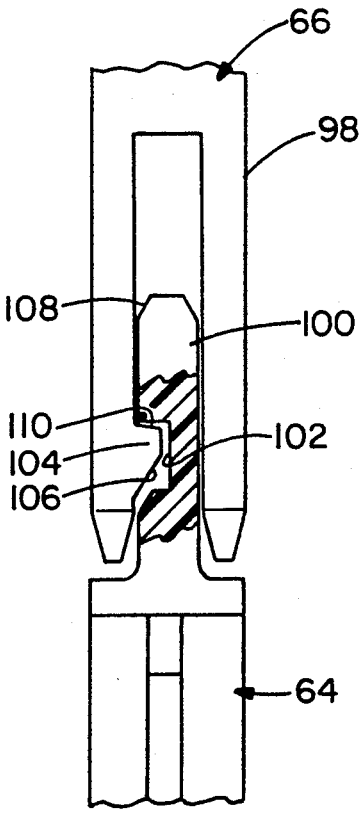
FIG. 4 is a partial sectional view of the interconnection of the upper and lower actuator rods.

A clevis 98 is maintained at an end of the upper actuator rod 66 and is adapted to engage the tip 100 of the lower actuator rod 64. As shown in FIG. 4, a recess or receptacle 102 is provided in an end portion of the lower actuator rod 64 and is adapted to receive a barb 104 of the clevis 98. The barb 104 has a tapered or ramped leading surface 106 adapted to engage a tapered surface 108 at the end of the tip 100. As the rods 64, 66 are moved toward each other during assembly and interconnection of the upper and lower handle portions 10, 12, the tapered surface 106 engages the tapered surface 108 and deflects the clevis 98 such that the tip 100 may pass over the barb 104 until such barb is received within the receptacle 102. In like manner, a tapered surface 110 at the trailing edge of the barb 104 facilitates disengagement of the tip 100 from the clevis 98. For purposes of security of the engagement so defined, it is preferred that the taper 106 be more gradual than the abrupt taper 110. Those skilled in the art will readily appreciate that with the actuator rod portions 64, 66 being in alignment with each other when the upper and lower handle portions 10, 12 are in similar alignment, the sliding interconnection of the handle portions to engage the tab 30 in the receptacle 28 similarly causes locking engagement between the clevis 98 and the tip 100. The interconnected rod portions 64, 66 thus form an integral actuator rod, the downward movement of which is limited by the lip 87 with the guide 78 as discussed above.

Figure 5:
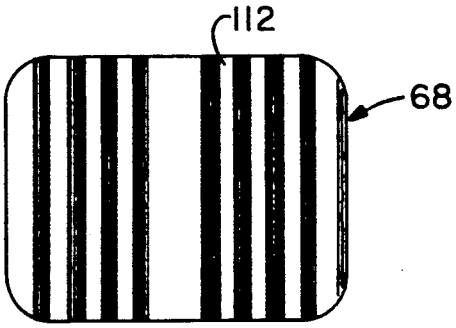
FIG. 5 is a top plan view of the actuator button of the invention.
Figure 6:
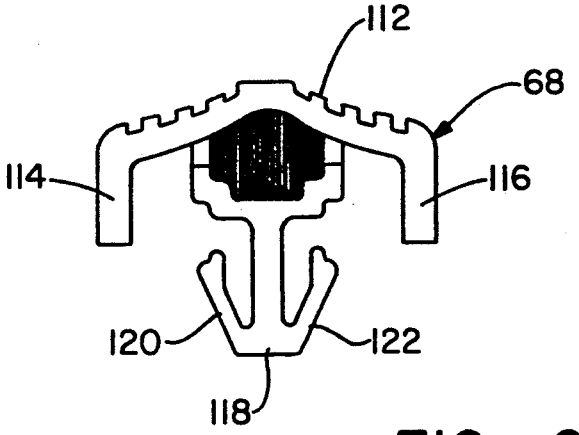
FIG. 6 is a side elevational view of the actuator button of FIG. 5.

As shown in FIGS. 5 and 6, the actuator button 68 is provided with a ribbed or textured head 112 to accommodate the user's thumb or digits. End flanges 114, 116 extend downwardly at opposite ends of the head 112. In like manner, a latch 118 is maintained between the end flanges 114, 116, such latch comprising a pair of deflectable prongs 120, 122.

As shown in FIG. 3, the upper actuator rod 66 is characterized by an end portion 124 adapted to receive the actuator button 68. The end portion 124 includes a rectangular aperture 126 passing therethrough, a rectangular slot 128 at the end thereof, and another rectangular aperture 130 interposed between the aperture 126 and slot 128. It will be readily appreciated that the aperture 130 is adapted to receive the latch 118 with the prongs 120, 122 deflectably compressing as they pass therethrough and expanding once so passed to provide a retaining function. It will similarly be appreciated that the end flange 116 is adapted to be received within the slot 128 while the flange 114 is adapted for receipt in the aperture 126. When the actuator button 68 is engaged in the apertures and slot of the end portion 124, the prongs 120, 122 substantially prevent withdrawal. However, with the button 68 being fabricated of a sufficiently flexible plastic material, removal of the button from the end portion 124 is possible when desired.

With reference now to FIG. 1A, it can be seen that a plate 132 extends as a portion of the hand grip 16 and is provided with a slot 134 therein. The slot 134 is positioned with respect to the end portion 124 of the upper actuator rod 66 such that the end flanges 114, 116 and the latch 118 may pass therethrough. Accordingly, the head 112 of the button 68 is maintained on an outside of the plate 132, while the end portion 124 of the rod 66 is maintained on the opposite side, within the cavity defined by the upper handle portion 10. It should be appreciated that the plate 132 and the bearing surface 86 provide sliding support for the upper actuator rod 66.

For ease of assembly of the vacuum cleaner and to assure interconnection of the clevis 98 and tip 100 of the respective rod portions 66, 64, a wedge is positioned in the slot 134 between the button 68 and the rearward portion of the slot 134 nearest the end of the hand grip 16. This wedge, placed prior to packaging and removed after assembly, assures locked extension of the rod 66 at the time of assembly. Accordingly, when the upper and lower handle portions 10, 12 are forcefully mated, the clevis 98 mates with the tip 100 because the lower rod 64 is restricted from movement by the engagement of the lip 87 with the associated guide 78, while the upper rod 66 is similarly restricted by the wedge within the slot 134.

Thus it can be seen that the objects of the invention have been satisfied by the structure presented above. While in accordance with the patent statutes only the best mode and preferred embodiment of the invention have been presented and described in detail, it is to be understood that the invention is not limited thereto or thereby. Accordingly, for an appreciation of the true scope and breadth of the invention reference should be made to the following claims.

What is claimed is:

1. A remote switch actuating mechanism in combination with a vacuum cleaner having first and second, upper and lower, separable handle portions comprising:

(a) a manual switch member mounted in said first, upper portion of said handle;

(b) a multipart operating rod attached to said switch member for actuation thereby;

(c) an engageable means for securing said parts of said rod together; and (d) said operating rod having a first part received in said upper handle portion and a second part received in said lower handle portion.

2. The remote switch actuating mechanism and vacuum cleaner of claim 1 wherein:

(a) a fastening means is engaged by interengagement of said upper and lower handle portions.

3. The remote switch actuating mechanism and vacuum cleaner of claim 2 wherein:

(a) said fastening means comprises a clevis on one of said first and second rod parts that telescopically receives the other of said first and second rod parts.

4. The remote switch actuating mechanism and vacuum cleaner of claim 1 wherein:

(a) said second part of said operating rod is slidingly received within guides in said lower handle portion, and (b) stop means on one of said first and second parts of said operating rod engage one of said guides.

5. The remote switch actuating mechanism and vacuum cleaner of claim 1 wherein:

(a) a portion of said first part of said operating rod includes an elbow slidingly received upon a bearing surface.

6. The remote switch actuating mechanism and vacuum cleaner of claim 5 wherein:

(a) said elbow configures said first part of said operating rod to track a contour of said upper handle portion.

7. A remote switch actuating mechanism mounted in a housing and comprising:

(a) a switch;

(b) an operating rod for switch actuation;

(c) a switch button driving said operating rod;

(d) said button including an operator contactable portion disposed outside such housing and a portion for attachment to said operating rod;

(e) said attachment portion extending through said housing;

(f) said attachment portion having a latch also extending through an aperture in said rod for attachment thereto;

(g) said rod having first and second receptacles on opposite sides of said aperture;

(h) said attachment portion including a pair of flanges one on each side of said latch; and (i) said flanges received by respective ones of said first and second receptacles.

* * * * *